US012799733B1

(12) United States Patent
Dunn et al.

(10) Patent No.: US 12,799,733 B1
(45) Date of Patent: Nov. 17, 2026

(54) PCM INTEGRATED PANEL/TILE USING BASE PANEL/BOARD AS A FORMING MEDIUM FOR ENCAPSULATION

(71) Applicant: ARMSTRONG WORLD INDUSTRIES, INC., Lancaster, PA (US)

(72) Inventors: Michael Roscoe Dunn, Concord, NC (US); Peter Franz Horwath, New London, NC (US)

(73) Assignee: AWI Licensing LLC, Wilmington, DE (US)

( * ) Notice: Subject to any disclaimer, the term of this patent is extended or adjusted under 35 U.S.C. 154(b) by 191 days.

(21) Appl. No.: 18/487,967

(22) Filed: Oct. 16, 2023

Related U.S. Application Data

(60) Provisional application No. 63/416,595, filed on Oct. 16, 2022.

(51) Int. Cl.
*E04B 1/78* (2006.01)
*E04B 1/76* (2006.01)

(52) U.S. Cl.
CPC ..... *E04B 1/7608* (2013.01); *E04B 1/78* (2013.01); *E04B 2103/04* (2013.01)

(58) Field of Classification Search
CPC ..... E04B 1/7608; E04B 1/78; E04B 2103/04
USPC ..... 52/404.1
See application file for complete search history.

(56) References Cited

U.S. PATENT DOCUMENTS

| | | | | |
|---|---|---|---|---|
| 5,770,295 | A * | 6/1998 | Alderman | E04B 9/045 428/323 |
| 6,672,024 | B2 * | 1/2004 | Alderman | E04F 21/18 52/404.3 |
| 6,769,223 | B2 * | 8/2004 | Alderman | E04D 15/06 270/30.13 |
| 7,704,584 | B2 * | 4/2010 | Alderman | C08K 3/32 165/104.19 |
| 11,761,211 | B2 * | 9/2023 | Alderman | E04D 13/17 52/302.3 |
| 2003/0061776 | A1 * | 4/2003 | Alderman | F28D 20/02 52/406.1 |
| 2008/0312359 | A1 * | 12/2008 | Alderman | C08K 3/32 524/415 |
| 2009/0011171 | A1 * | 1/2009 | Alderman | E04B 1/78 428/72 |
| 2009/0031659 | A1 * | 2/2009 | Kalfon | H05K 5/0209 137/511 |
| 2011/0120040 | A1 * | 5/2011 | Alderman | E04B 2/707 165/46 |
| 2019/0106878 | A1 * | 4/2019 | Alderman | F28D 20/025 |
| 2021/0062510 | A1 * | 3/2021 | Alderman | E04B 1/7612 |

* cited by examiner

*Primary Examiner* — James J Buckle, Jr.
(74) *Attorney, Agent, or Firm* — Patrick Sheldrake

(57) ABSTRACT

A building panel comprising a base form defining a pocket. A first liner layer is molded to the shape of the base form pocket. A phase change material is disposed over the first liner layer. A second liner layer is disposed over the first layer to encapsulate the phase change material. The first liner layer can be molded to the shape of the base form using a vacuum or plug mold thermoform process. Further, the base form can define micropores enabling vacuum forming of the first or second liner layer.

18 Claims, 4 Drawing Sheets

Before Forming

PCM INTEGRATED PANEL/TILE USING BASE PANEL/BOARD AS A FORMING MEDIUM FOR ENCAPSULATION

CROSS-REFERENCE TO RELATED APPLICATIONS

This application claims the benefit of U.S. Provisional Application No. 63/416,595 filed Oct. 16, 2022 entitled PCM INTEGRATED PANEL/TILE USING BASE PANEL/BOARD AS A FORMING MEDIUM FOR ENCAPSULATION, the contents of which are incorporated herein by reference in their entirety

FIELD OF THE DISCLOSURE

The present disclosure pertains generally to the combination of building panel systems and phase change material (PCM). Particular embodiments of the disclosure relate to ceiling, insulation, or building panel systems containing a blend or blends of PCM as part of a manufactured product. Application of such systems apply equally to suspended ceiling systems, attics, surface mounted ceiling tiles, above or below roof or floor deck applications, as well as hanging, canopy, or baffle type systems.

BACKGROUND

In almost all climates across the world, the temperatures overnight are much cooler than during the daytime. For this reason, many home-owners open their windows at night to take advantage of these low temperatures and cool down their homes. Similarly, many commercial and industrial buildings make use of "economizer" or "free cooling" to bring in cool outside air overnight and drop the temperature of their building, ready for another day of heat gain In recent years the use of phase change materials has become increasingly explored and used within the building industry as a means of storing thermal energy at optimal building temperatures. Products currently exist in a range of forms and functions which behave as an architectural element within a building. Such examples include polyfilm mats with pockets of PCM encapsulated between, plastic containers which are formed and sealed with PCM injected, embedded or formed within the product.

A range of products also exist with phase change materials in tiny pellets, beads or some other form that is micro-encapsulated within the products manufacturing materials. Such an example may include a gypsum board. Further examples include existing or custom designed products with PCM products laminated, laid in place, painted, overlaid or coming in contact with said products to provide enhanced performance or ease of use for one product or the other. More recent examples include thermoformed PVC panels with filled and sealed PCM, placed between, over or adjacent to conventional building products such as ceiling tiles, metal panels, insulation, siding or roofing.

Many of these products are made from plastics, metals or other fibrous materials common to the building industry, but have been designed with manufacturing efficiency and simplicity in mind and not installation and design efficiency. Furthermore, any manufacturing efficiencies tend to be isolated to the PCM product itself, and not to its ease of integration or inline manufacturing with conventional products such as ceiling tiles or insulation boards.

SUMMARY

There is currently no technology available that takes an existing building product such as ceiling tiles or insulation boards, and shapes them in such a way as to create a form or "tool" for shaping and encapsulating an integrated PCM. Many solutions exist where tooling is required to form a plastic, polymer or metal part which is then injected and sealed with PCM, but no such solutions use the building product itself as the actual tooling or mold. Furthermore, there is no technology which also incorporates gel agents within mineral based PCM formulations, designed specifically to control leaking and settling of PCM.

The present disclosure describes an inexpensive method to produce PCM enhanced panels and tiles which can be used for applications that include but are not limited to walls and ceilings. These assemblies could replace or be used in addition to existing wall, floor, and/or ceiling panels/tiles and product energy savings and comfort improvement. This process allows for the integration of phase change materials into wall, floor, and/or ceiling panels/tiles, using a thermoformed pockets without the need for additional molds or forms.

Manufacturing of the subject PCM enhanced panels further eliminates the need for a mold to thermoform the plastic encapsulate of the phase change materials, by utilizing the panel geometry itself as the mold. Low-cost materials including recycled products and/or wood or other organic material or plastics or fiber material byproducts could be used to manufacture the panels to further reduce the cost. This system is ideal for cellulose or mineral fiber ceiling tiles, however the panel component is not limited to mineral fiber or cellulose type materials as any solid material could be used.

The present disclosure makes use of a building panel such as mineral fiber tiles, acoustic panels, insulation panels behaving as a form, and combines a polymer plastic layer to be formed by the building panel, a spray applied layer to be applied to building panel, a phase change panel using mineral based PCM materials, and secondary polymer plastic layer to overlay and seal over the panel. The present disclosure is agnostic to any one material selection or combination of materials within this combination. The polymer plastics used could be PE, PVC, PC, PA (Nylon) and or could be multi-layered films, laminated films or rigid plastics. PCM's could also be organic or inorganic. Examples of mineral/inorganic PCM's could be calcium chloride, magnesium chloride and more.

The subject building panels can made of mineral fiber, foam, polyiso board, felt or other similar base panels. The panels can be shaped into profiles that lend themselves to behaving as pockets or cells for filling of a phase change material. The profiles support against deflection of adjoining materials. Supporting ridges can be used to allow the insertion of a reinforcing bar, rod, stick or other rigid supporting product to be sealed in place to achieve zero deflection, or control structural support requirement in specific conditions. This reinforcing profile, per say, aids in panels being placed over the top of support rails designed for brackets, rods or guy wires that are laid or secured in place within the building structure and spaced in such a way such that the panels are simply laid over rails at pre-determined spacing.

The panels are provided with a formable layer such as a polymer, multi-layered or single layered film or plastic or metal, which is capable of encapsulating a specific PCM formulation. Heat, pressure, vacuum or even secondary plug can be provided assist to draw a formable layer over the building panel to combine both products and deliver a base for injection of a phase change material. The PCM is injected and sealed for encapsulation into a cell, pocket or form within the building product, over the first formable plastic layer which behaves as an encapsulation material.

A second formable layer such as a polymer, multi-layered or single layered film or plastic or metal, which is capable of encapsulating a specific PCM formulation, and bonding in some way to the bottom first formable layer by such means as thermal seal, chemical seal, pressure or some other means is provided, thereby encapsulating a PCM. Additional layers can be added for improved features or performance, such as foil facings, insulation, wood or other materials for aesthetics, fire, acoustic, thermal or other benefits.

PCMs of mineral/inorganic nature, of varying base chemicals can be used in such an application such as calcium chloride, sodium chloride, zinc chloride, magnesium chloride and other mineral compounds, and containing or combining with a Hydroxyethylcellulose (HEC) mixture to act as a gelling agent to stabilize PCM, and provide stability from settling, leaking and form stability from leaks.

The building product of the subject disclosure is designed with profiles that not only provide a cell or pocket for forming encapsulation materials, and housing a PCM, but also are designed in such a way with profiles to maximize stability and strength to optimize any sag and durability issues within the same integrated solution. Holes or openings in the design of the product is also contemplated for drawing air or a vacuum if not porous enough, to aid in thermoforming or vacuum forming over the panel.

A profile or layout of PCM cells and ridges in the building panel aid in rigidity, but also that allow for cutting or reducing size to a certain size such as half, quarter, third cuts across defined locations. The panel or shell can be a specific dimension of 603 mm×603 mm (+/−) 5%, and 609 mm×406 mm (+/−) 5%, 609 mm×450 mm (+/−) 5%, 609 mm×304 mm (+/−) 5% and 304 mm×304 mm (+/−) 5%, 1200 mm×600 mm (+/−) 5%.

The panel design of the subject disclosure is applicable to vertical, horizontal, angled, convex or concaved surface applications, either as separate units/modules or within a complete assembly to form a system or product such as a tent, storage container, enclosure, wrap, jacket, blanket or tile. Such panels can be reversed or flipped to take advantage of a flat surface finish or a profiled/stamped profile finish depending on application preference. The panels can provide a flat surface for lamination, adherence or attachment of additional products or features such as acoustical treatment, surface coverings, treatments or designs.

Thus, the present disclosure describes technology specifically designed to optimize heat exchange properties, with shapes, forms and features designed to foster quick, and simple integration with typical installation conditions including but not limited to; placement within suspended ceiling framing systems, fastening to or hanging from walls, ceilings or other surfaces; saddling over; suspending from; laying over; laying in; inserting or engaging within a variety of standard commercial and residential construction features.

Advantages of this system include the case of integration into exist building products manufacturing processes. This adaptation dramatically simplifies the integration of phase change materials into the construction industry and quickly deliver significant energy savings and comfort improvements. Further advantages of the disclosure provide a low cost method to produce PCM enhanced panels, ceiling tiles, floor tiles, roof panels, and insulation boards. Also, the PCM enhanced thermoformed products do not require an additional mold, but uses a formed base as both a tool/mold and as a finished surface.

The subject technology relates to a building panel having a base form defining a pocket, a first liner layer molded to the shape of the base form pocket, a phase change material disposed over the first liner layer, and a second liner layer disposed over the first layer to encapsulate the phase change material. The first liner layer may be molded to the shape of the base form using a vacuum or plug mold thermoform process. The base form may further define micropores enabling vacuum forming of the first or second liner layer. The first liner layer may be a film, polymer, or membrane. The first liner layer may be thermoformed, rolled, or spread onto the base form. The building panel may additionally include a third liner layer disposed over the second liner layer, the third liner layer including finish laminate, a reflective foil liner, or an insulation layer. The base form may be an insulation panel. Further, the base form may a first and second pocket with a divider disposed between the pockets;

The subject technology relates to a method for manufacturing a building panel. The method includes shaping a pocket within a building panel, thermoforming a liner layer to the pocket of the building panel, injecting a phase change material into the pocket such that the phase change material is cradled by the liner layer, and bonding a sealing layer film over the pocket to encapsulate the phase change material.

The method may include combining a gelling agent with the phase change material to create a fixed phase change material that softens but does not flow. The method may include forming micropores in the pocket of the building panel. The method may include vacuuming the liner layer through the micropores to mate the liner layer with the pocket. The method may include disposing a reflective layer over the sealing layer film.

BRIEF DESCRIPTION OF THE DRAWINGS

Various aspects of the present disclosure are discussed herein with reference to the accompanying Figures. It will be appreciated that for simplicity and clarity of illustration, elements shown in the drawings have not necessarily been drawn accurately or to scale. For example, the dimensions of some of the elements can be exaggerated relative to other elements for clarity or several physical components can be included in one functional block or element. Further, where considered appropriate, reference numerals can be repeated among the drawings to indicate corresponding or analogous elements. For purposes of clarity, however, not every component can be labelled in every drawing. The Figures are provided for the purposes of illustration and explanation and are not intended as a definition of the limits of the disclosure.

DETAILED DESCRIPTION

Figure 1:
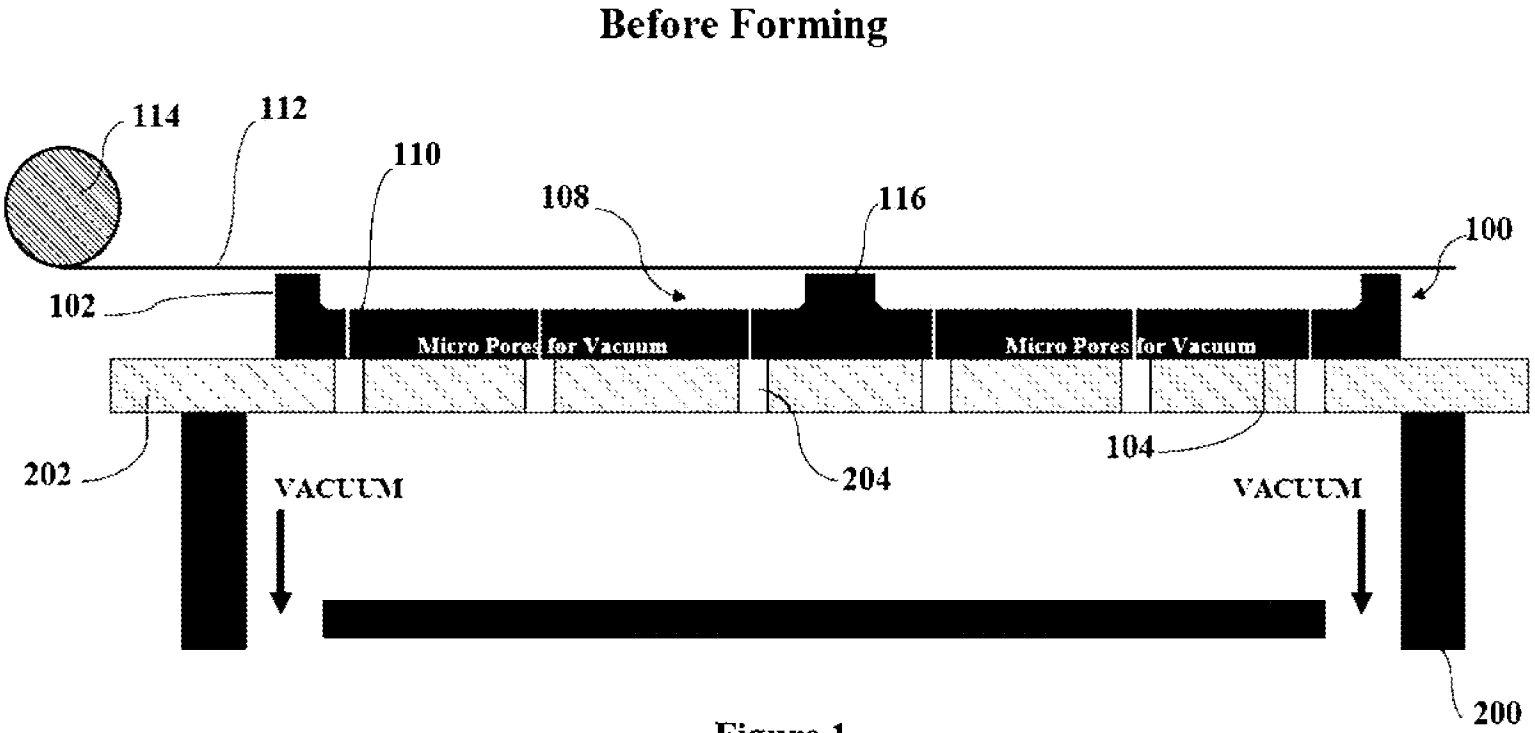
FIG. 1 illustrates components of a PCM Cellulose or mineral fibre ceiling tile assembly in a manufacturing line in cross-sectional view in accordance with the subject technology.

The subject technology overcomes many of the prior art problems associated with energy savings and comfort improvement by utilizing the actual structure of the building to help control temperature. The advantages, and other features of the technology and methods disclosed herein, will become more readily apparent to those having ordinary skill in the art from the following detailed description of certain preferred embodiments taken in conjunction with the drawings which set forth representative embodiments of the present technology and wherein like reference numerals identify similar structural elements. Directional indications such as above, underneath, upward, downward, right, left and the like are used with respect to the figures and not meant in a limiting manner.

In brief overview, the subject technology is an inexpensive method to produce phase change materials enhanced panels, tiles insulation and the like. The phase change materials activated panels and tiles can be used for applications that include but are not limited to walls, floors and ceilings. These panels and tiles could replace or be used in addition to existing wall, floor, and/or ceiling panels/tiles to produce energy savings and comfort improvement. This method provides integration of phase change materials into wall, floor, and/or ceiling panels/tiles, using a thermoformed pocket without the need for additional molds or forms. This procedure eliminates the need for a mold to thermoform the plastic encapsulate of the phase change materials, by utilizing the panel geometry itself as the mold. Low-cost materials including recycled products and/or wood or other organic material or plastics or fiber material byproducts could be used to manufacture the panels to further reduce the cost. This system is ideal for cellulose or mineral fiber ceiling tiles however the panel component is not limited to mineral fiber or cellulose type materials as any solid material could be used.

Referring now to the FIG. 1, there is shown components of a PCM Cellulose or mineral fiber ceiling tile assembly in a manufacturing line in accordance with the subject technology. The tile or panel assembly 100 would be manufactured using a multiple step process. The manufacturing line includes a table 200 having a table top 202. The table top 202 forms a plurality of passages 204 so that when vacuum is applied to the passages from below, articles will be fixed to upon the table top 202 by the vacuum.

Figure 2:
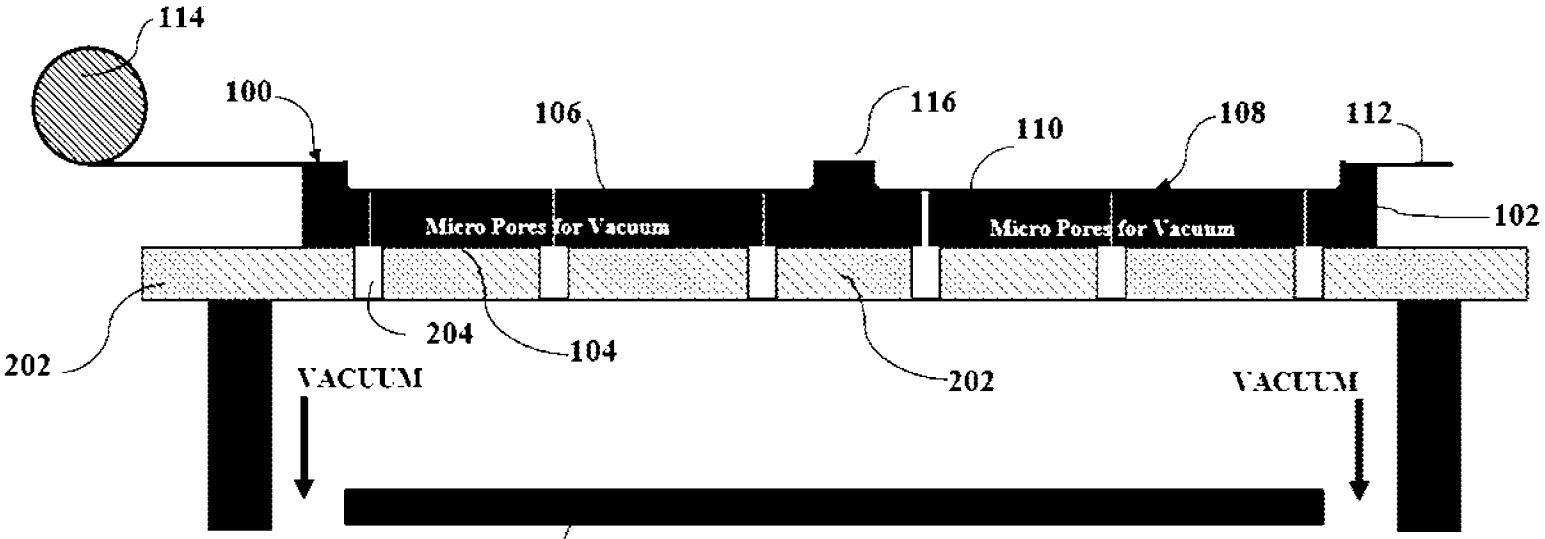
FIG. 2 illustrates the components of the tile assembly of FIG. 1 wherein a thermos-formable layer is drawn into cavities in the tile by vacuum in cross-sectional view in accordance with the subject technology.

The tile assembly 100 includes a base 102 having a substantially planar lower surface 104 and an upper surface 106 forming depressions 108 with intermittent optional dividers 116. The base 102 defines micropores 110 that align with at least some of the passages 204 so that the vacuum passes to the upper surface 106. Once the base 102 is in such position, a thermoform layer 112 may be applied. The thermoform layer 112 may be provided on a roll 114 for easy spreading across all or desired portions of the base 102. Preferably, the thermoform layer 112 is flexible so that the vacuum pulls downward on the layer 112 so that the layer 112 tightly covers the contoured upper surface 106 as shown in FIG. 2. As a result of the thermoform layer 112 being drawn into the depressions 108, reservoirs with a lower seal are formed. An adhesive or other method may be used to fix the thermoform layer 112 to the base 102.

When manufacturing of a building product such as a ceiling tile, insulation board, foam board or similar building panel product, a typical thickness of the base 102 ranges from ½" to 1" or more or less. In one embodiment, the micropores 110 are strategically placed to aid in vacuum forming for the particular polymer layer 112. Preferably, the thermoform layer is a flexible film, polymer, plastic. The thermoform layer can also be a laminating metal or other material adhered to the building panel substrate. The end result shown in FIG. 2 is a base 102 with layered reservoirs of any shape that can acts as a tool for continued forming of the tile assembly 100 and remain as a portion of the finished tile assembly 100.

Figure 3:
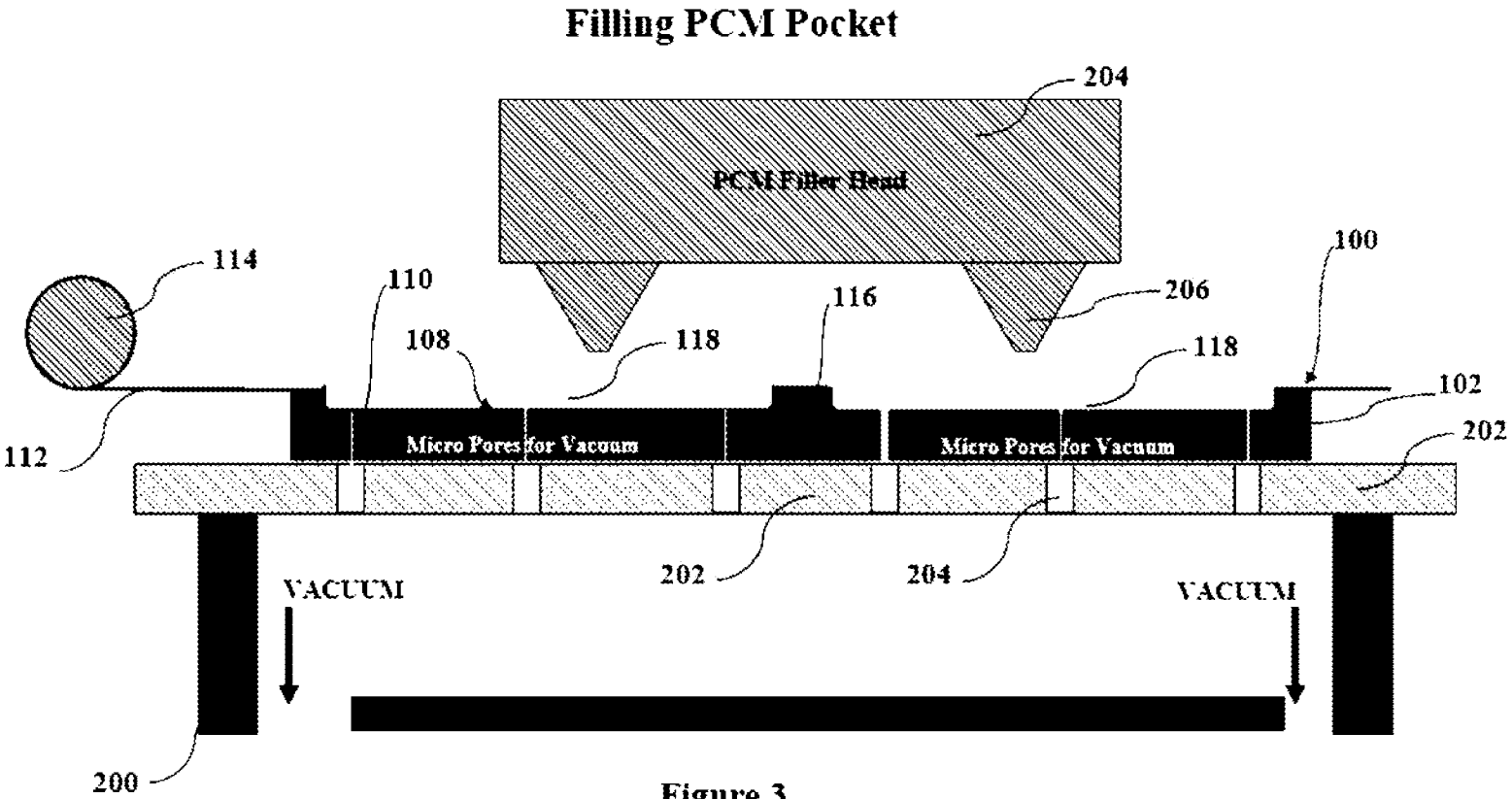
FIG. 3 illustrates the components of the tile assembly of FIGS. 1 and 2 wherein PCM material is deposited into formed reservoirs in cross-sectional view in accordance with the subject technology.

Referring now to FIG. 3, the components of the tile assembly 100 of FIGS. 1 and 2 wherein PCM material 118 is deposited into formed layered depressions or reservoirs 108 are shown. The manufacturing line includes a PCM filler head 204 that dispenses the PCM material 118. In one embodiment, the head 204 includes a plurality of nozzles 206 that align with two or more reservoirs 108 simultaneously for fast filling. It is envisioned that the head 204 and table 200 may be part of a single machine. For example, the head 204 may be mounted on a gantry (not shown) for precisely controlled dispensing and movement about the tabletop 202. The head 204 will typically fill each reservoir with PCM material 118. Preferably, injecting or filling the reservoirs 108 with PCM material 118 as desired does not create sag or structural support issues in the base 102.

An optional absorbent chemical, such as a Sodium Polyacrylate or Hydroxyethylcellulose (HEC) in powder or fluid form, may be added to help control leakage and improve noise control, as well as reducing settling of PCM material 118 without impacting mineral crystallization. In another embodiment, an optional bar or rod or other structural feature (not shown) is fit within a nesting area of the base and or reservoir to create a stiffening or support mechanism as needed. The dividers 116 may also provide the stiffening and support benefit alone or in combination with additional features. The base 102 could have features such as V, U or similar profile grooves designed for adding strength to the resulting tile assembly. The tile assembly could also have increased thickness in certain areas to provide stiffness or rigidity that overcomes thinned areas for PCM filled depressions.

Figure 4:
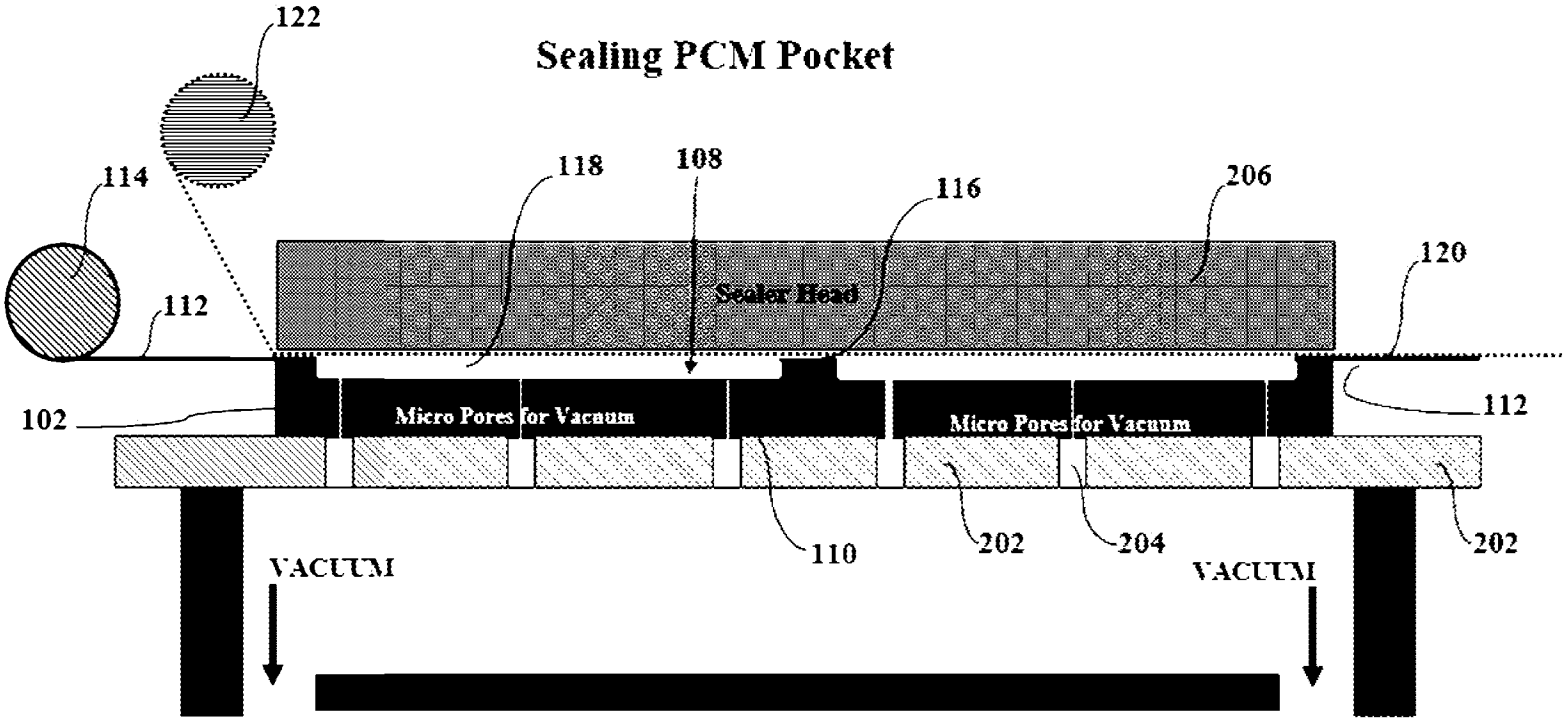
FIG. 4 illustrates the components of the tile assembly of FIGS. 1-3 wherein a second layer is drawn across and sealed to the first creating encapsulated PCM pockets in cross-sectional view in accordance with the subject technology.

Referring now to FIG. 4, the components of the tile assembly 100 of FIGS. 1-3 wherein a second sealing layer 120 is drawn across and sealed to the first creating encapsulated PCM pockets in accordance with the subject technology. The sealing layer 120 may also be dispensed from a roll 122, applied in sheets, and the like. Once in position, a sealing head 206 may heat seal fixes the sealing layer 120 in place to create a finished rigid or semi-rigid tile assembly 100. The sealing head 206 may use a sealing process such as heat sealing, chemical sealing and the like. Once the sealing head 206 is fixed, a cutting knife assembly (not shown) may be used to free the rolls 114, 122. The sealing head 206 and knife assembly also may be part of the machine and move on the same or similar gantry.

In another embodiment, the tile assembly or panel has additional layers of rigid or flexible insulation materials to help drive thermal energy in the desired direction for the panel's application. An example would be a panel used in a ceiling which would have a layer of insulation laminated to, or embedded thereon above finished ceiling side to help insulate the performance and conductivity of the phase change materials down to the space below, or away from warm/hot attics or plenums. Another example would be a foil liner designed to improve heat reflection or improve flammability performance for plenum ceiling conditions.

The panel may also incorporate forms which are specifically designed to create a "nest" for support rods, angles or bars which can be used to support or transfer support or weight of the product to adjoining support bars or framing. Such forms help aid in deflection management as well as meeting specific structural or seismic requirements.

The phase change materials contained could be of any kind now known or later developed, but are commonly designed to be salt-hydrate PCM based. Said PCM's would be specifically designed to meet or exceed fire resistance requirements. The PCM integrated panel or tile can be any shape and may have multiple layers which are built up through the manufacturing process.

The following is an example of using this method to integrate PCM into a mineral fiber ceiling tile. Extruded fiberboard, such as mineral fiber ceiling tiles or rigid insulation, could be manufactured using traditional method to serve as the base. These depressions act as the female form to create the PCM reservoir to be filled and sealed in the next steps. During forming the reservoirs, the heated thermoformable layer is drawn into the respective cavity via vacuum or pushed down by a die and bonded to the topside of the extruded fiberboard. Next, a filling station injects a predetermined quantity of PCM material into each PCM reservoir. At this stage, the bondable sealing layer film would be placed on top of the work piece and would be bonded to the lower layer to encapsulate the PCM materials. If desired, an additional layer such as a decorative surface or a reflective barrier could be added. This could also be integrated into the second layer if desired.

The subject technology also can provide a very rigid design in such a way with profiles to maximize stability and strength to optimize any sag and durability issues within the same integrated solution. The layout of PCM reservoirs, dividers and not only aid in rigidity, but also allow for cutting to reduce to a certain size such as half, quarter, third cuts across predefined locations. Commonly, the tile assembly is one of the following dimensions: 603 mm×603 mm (+/−) 5%; and 609 mm×406 mm (+/−) 5%; 609 mm×450 mm (+/−) 5%; 609 mm×304 mm (+/−) 5%; 304 mm×304 mm (+/−) 5%; or 1200 mm×600 mm (+/−) 5%. The tile supporting structure can be formed in such a way that the tile assembly are simply laid or secured in place within the building structure, and spaced in such a way that said panel is laid over rails at the pre-determined spacing.

It is envisioned that the tile assemblies can be used in a vertical, horizontal, angled, convex or concaved surface application and either as separate units/modules or within a complete assembly to form a system or product such as a tent, geodesic dome, storage container, enclosure, wrap, jacket, blanket or tile. Additional layers may also provide a reversible finish so that the panel may be reversed or flipped to take advantage of a flat surface finish or a profiled/stamped profile finish depending on preference. It is also possible to provide said flat surface for lamination, adherence or attachment of additional products or features such as acoustical treatment, surface coverings, treatments or designs. It is also possible to have features specifically designed to optimize heat exchange properties, but with shapes, forms and features designed to foster quick, and simple integration with typical installation conditions including but not limited to; placement within suspended ceiling framing systems, fastening to or hanging from walls, ceilings or other surfaces; saddling over; suspending from; laying over; laying in; inserting or engaging within a variety of standard commercial and residential construction features.

Turning to some phase change material formulations, it is possible to make use of phase change materials of a mineral/inorganic nature, of varying base chemicals such as calcium chloride, sodium chloride, zinc chloride, magnesium chloride and other mineral compounds, and containing or combining with a Hydroxyethylcellulose (HEC) mixture to act as a gelling agent to stabilize PCM, and provide stability from settling, leaking and form stability from leaks.

As would be appreciated by those of ordinary skill in the pertinent art upon review of the subject disclosure, the subject technology has many uses. For example, it may be used as acoustical panels, ceiling tiles and wall boards. Mineral fiber, cellulose fiber and other types of boards or panels typically used for interior ceiling tiles, wall panels and coverings could act as the base layer which provides the form for PCM pockets, serving as an interior finish or acoustical ceiling/wall solution which provides comfort and energy savings benefits. The subject technology may also be used for roofing and insulation boards. Insulation and other roofing type boards and decking materials could also be used as the base layer providing the form for PCM pockets, servicing the roofing and construction industries to provide added comfort, fire, thermal protection and energy savings.

Once deployed, the integrated phase change building panel, tile or board behaves as a heat storage system to absorb and release heat at a set temperature when incorporated into a building or thermal storage system. In lieu of adding pre-encapsulated phase change material to existing building panel solutions such as other products which rely on adding containers, mats or panels of PCM over, under or between other panel products, the present technology can combine building panels directly with PCM by having trays, pockets, pillows, reservoirs or cells which would be formed into the building panel or base, then the building base is used as a form for a plastic encapsulation to be thermoformed or vacuum formed or stamped over the panel, and then injected with a PCM material to be sealed by a second encapsulation layer. Optionally the mineral based PCM is combined with a gelling agent to create a fixed PCM structure that softens but does not flow or leak, and a form design with cells or pockets distributed in singular or plurality across the panel to spread the PCM loading for even heat storage potential and design appearance. The finished product is capable of acting as both a PCM encapsulation material as well a finished product capable of supporting itself and capable of incorporating a range of finish treatment options.

It will be appreciated by those of ordinary skill in the pertinent art that the functions of several elements may, in alternative embodiments, be carried out by fewer elements, or a single element. Similarly, in some embodiments, any functional element may perform fewer, or different, operations than those described with respect to the illustrated embodiment. Also, functional elements (e.g., table, table top, heads and the like) shown as distinct for purposes of illustration may be incorporated within other functional elements in a particular implementation. Further, although the subject technology has been described with respect to ceiling tiles, it is envisioned that the subject technology would be equally applicable to other applications such as walls and floors.

While the subject technology has been described with respect to preferred embodiments, those skilled in the art will readily appreciate that various changes and/or modifications can be made to the subject technology without departing from the spirit or scope of the invention as defined by the appended claims.

What is claimed is:

1. A building panel comprising:

a base form having a planar lower surface and an upper surface defining at least one depression;

a first liner layer molded to the at least one depression of the base, the first liner layer extending over the upper surface of the base adjacent the at least one depression;

a phase change material disposed over the first liner layer within the at least one depression; and a second liner layer disposed over the first layer to encapsulate the phase change material, the second liner layer extending over the at least one depression and over the upper surface of the base adjacent the at least one depression.

2. The building panel of claim 1, wherein the base form further comprises a second depression and at least one divider positioned between the at least one depression and the second depression.

3. The building panel of claim 1, wherein the base form further defines micropores extending from the lower surface to the upper surface enabling vacuum forming of the first or second liner layer over the upper surface and into the at least one depression.

4. The building panel of claim 1, wherein the first liner layer is a film, polymer, or membrane.

5. The building panel of claim 1, wherein the base form comprises mineral fiber or cellulose fiber.

6. The building panel of claim 1, further comprising an additional third liner layer disposed over the second liner layer, the third liner layer including finish laminate, a reflective foil liner, or an insulation layer.

7. The building panel of claim 1, wherein the base form is an insulation panel.

8. A building panel having a bottom surface opposing a top surface, the building panel comprising:

a base form having a first surface opposing a second surface defining a first and second pocket with a divider disposed between the pockets;

a first liner layer disposed over the first and second pocket, the first liner layer mating with the base form and extending over the divider disposed between the first and second pockets;

a phase change material disposed over the first liner layer within the first and second pockets; and a second liner layer disposed over the first layer to encapsulate the phase change material, the second liner layer extending over the first and second pockets and over the divider disposed between the first and second pockets;

wherein the first surface of the base defines the bottom surface of the building panel; and wherein the second liner defines the top surface of the building panel.

9. The building panel of claim 8, wherein the base form comprises mineral fiber.

10. The building panel of claim 8, wherein the base form further defines micropores extending between the first surface and the second surface of the base, the micropores being in fluid communication with the first and second pockets to enable vacuum forming of the first liner layer over the divider and into the first and second pockets.

11. The building panel of claim 8, wherein the first liner layer is a film, polymer, or membrane.

12. The building panel of claim 8, wherein the phase change material comprises a chloride compound and hydroxyethylcellulose.

13. The building panel of claim 8, further comprising an additional third liner layer disposed over the second liner layer, the third liner layer including finish laminate, a reflective foil liner, or an insulation layer.

14. The building panel of claim 8, wherein the base form is an insulation panel.

15. An acoustic building panel having a top surface opposing a bottom surface, the acoustic building panel comprising:

a mineral fiber substrate having a first surface opposing a second surface, the substrate defining at least one recessed portion;

a polymeric liner over the at least one recessed portion and over portions of the first surface adjacent the at least one recessed portion;

a phase change material housed within the at least one recessed portion; and a second polymeric liner over the at least one recessed portion encapsulating the phase change material within the at least one recessed portion, the second polymeric liner extending over portions of the first surface adjacent the at least one recessed portion and defining the top surface of the acoustic building panel.

16. The acoustic building panel according to claim 15, wherein the substrate further defines a plurality of passages extending from the first surface to the second surface of the substrate, the plurality of passages being in fluid communication with the at least one recessed portion to enable vacuum forming of the polymeric liner over portions of the first surface adjacent the at least one recessed portion and into the at least one recessed portion.

17. The acoustic building panel according to claim 15, wherein the phase change material comprises a chloride compound and hydroxyethylcellulose.

18. The acoustic building panel according to claim 15, wherein the polymeric liner is thermoformed over the mineral fiber substrate and extends over the at least one recessed portion and portions of the first surface adjacent the at least one recessed portion.

* * * * *